US007849533B1

(12) United States Patent
Receveur et al.

(10) Patent No.: US 7,849,533 B1
(45) Date of Patent: Dec. 14, 2010

(54) OCCUPANT TRANSFER SHEET

(75) Inventors: Timothy Joseph Receveur, Guilford, IN (US); Christopher R. O'Keefe, Batesville, IN (US); Frederick Herman, Harrison, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 12/570,673

(22) Filed: Sep. 30, 2009

(51) Int. Cl.
*A61G 7/08* (2006.01)
*A47G 9/02* (2006.01)

(52) U.S. Cl. ..... 5/81.1 HS; 5/81.1 R; 5/497; 5/500; 5/925; 5/926

(58) Field of Classification Search ..... 5/81.1 HS, 5/81.1 T, 81.1 R, 625, 497, 499, 500, 485, 5/925, 926
See application file for complete search history.

(56) References Cited

U.S. PATENT DOCUMENTS

| | | | | | |
|---|---|---|---|---|---|
| 3,769,642 | A | * | 11/1973 | Warman | 5/81.1 T |
| 3,829,914 | A | | 8/1974 | Treat | |
| 4,051,565 | A | * | 10/1977 | Berge | 5/81.1 R |
| 4,868,938 | A | | 9/1989 | Knouse | |
| 5,138,731 | A | * | 8/1992 | Harcrow, Jr. | 5/625 |
| 5,249,320 | A | * | 10/1993 | Moretz et al. | 5/484 |
| 5,329,655 | A | | 7/1994 | Garner | |
| 5,465,441 | A | * | 11/1995 | Chun | 5/653 |
| 5,615,425 | A | * | 4/1997 | Corente | 5/81.1 T |
| 5,742,958 | A | | 4/1998 | Solazzo | |
| 5,860,174 | A | | 1/1999 | Failor | |
| 5,920,929 | A | * | 7/1999 | Hensley et al. | 5/81.1 T |
| 7,650,654 | B2 | | 1/2010 | Lambarth | |
| 2007/0000048 | A1 | | 1/2007 | Davis | |
| 2007/0180625 | A1 | | 8/2007 | Walke | |

FOREIGN PATENT DOCUMENTS

| | | | |
|---|---|---|---|
| WO | 94/20002 | A1 | 9/1994 |
| WO | 2008/108782 | A2 | 9/2008 |

OTHER PUBLICATIONS

A. Hill-Rom Solution V-Cue Dynamic Air Therapy Brochure, © Hill-Rom 1998, Hill-Rom Batesville, IN 47006 International (812) 934-8173 www.hill-rom.com.

U.S. Appl. No. 12/570,691, filed Sep. 30, 2009 First Named Inventor Timothy Joseph Receveur Assignee Hill-Rom Services Inc. 300 Delaware Ave. Suite 530 Wilmington, DE 19801.

* cited by examiner

*Primary Examiner*—Robert G Santos
(74) *Attorney, Agent, or Firm*—Kenneth C. Baran

(57) ABSTRACT

An occupant transfer device 34 for use on a host mattress 20 having a top side 22 and a flank 24 is in the form of a fitted sheet. The device has a top 36 for covering the top side of the mattress and a skirt 38 extending from the top. The top and skirt each have an occupant side 40, 44 and a mattress side 42, 46. Substantially all of the mattress side of the top exhibits relatively low friction; the occupant side of at least the top exhibits relatively higher friction.

10 Claims, 13 Drawing Sheets

OCCUPANT TRANSFER SHEET

TECHNICAL FIELD

The subject matter described herein relates to occupant transfer from one occupant support to another occupant support, and particularly to a fitted sheet for facilitating such transfer. One example application for the occupant transfer device is for transferring a patient from one bed to another.

BACKGROUND

In hospitals and other caregiving settings it is sometimes necessary to transfer a patient from one bed (the source bed) to another (the destination bed). One or more caregivers transfer the patient by lifting and/or sliding the patient from the source bed to the destination bed. The physical effort required of the caregivers increases with increasing patient size and weight.

Various devices are used to assist in patient transfers. These include reduced friction sheets or pads and powered surfaces that create an air cushion. These devices are not without merit, but also suffer from drawbacks. For example occupant transfer devices can be costly. In addition, occupant transfer devices are typically specialized devices dedicated to patient transfer rather than being intended for "full time" use on the bed. As a result, the device must be retrieved from a remote location and must be positioned under the patient before the transfer can take place. In addition, occupant transfer devices can be awkward to use, requiring the caregiver to bend at the waist in order to reach across the width of the destination bed and pull the transfer device, now bearing the patient's weight, onto the destination bed. The caregiver's posture along with the need to exert a substantial force increases the risk of caregiver injury.

Accordingly, it is desirable to provide a patient transfer device that addresses at least some of the shortcomings of existing devices.

SUMMARY

An occupant transfer device for use on a host mattress having a top side and a flank is in the form of a fitted sheet. The device has a top for covering the top side of the mattress and a skirt extending from the top. The top and skirt each have an occupant side and a mattress side. Substantially all of the mattress side of the top exhibits relatively low friction; the occupant side of at least the top exhibits relatively higher friction.

BRIEF DESCRIPTION OF THE DRAWINGS

The foregoing and other features of the various embodiments of the occupant transfer device described herein will become more apparent from the following detailed description and the accompanying schematic drawings in which.

DETAILED DESCRIPTION

Figure 1:
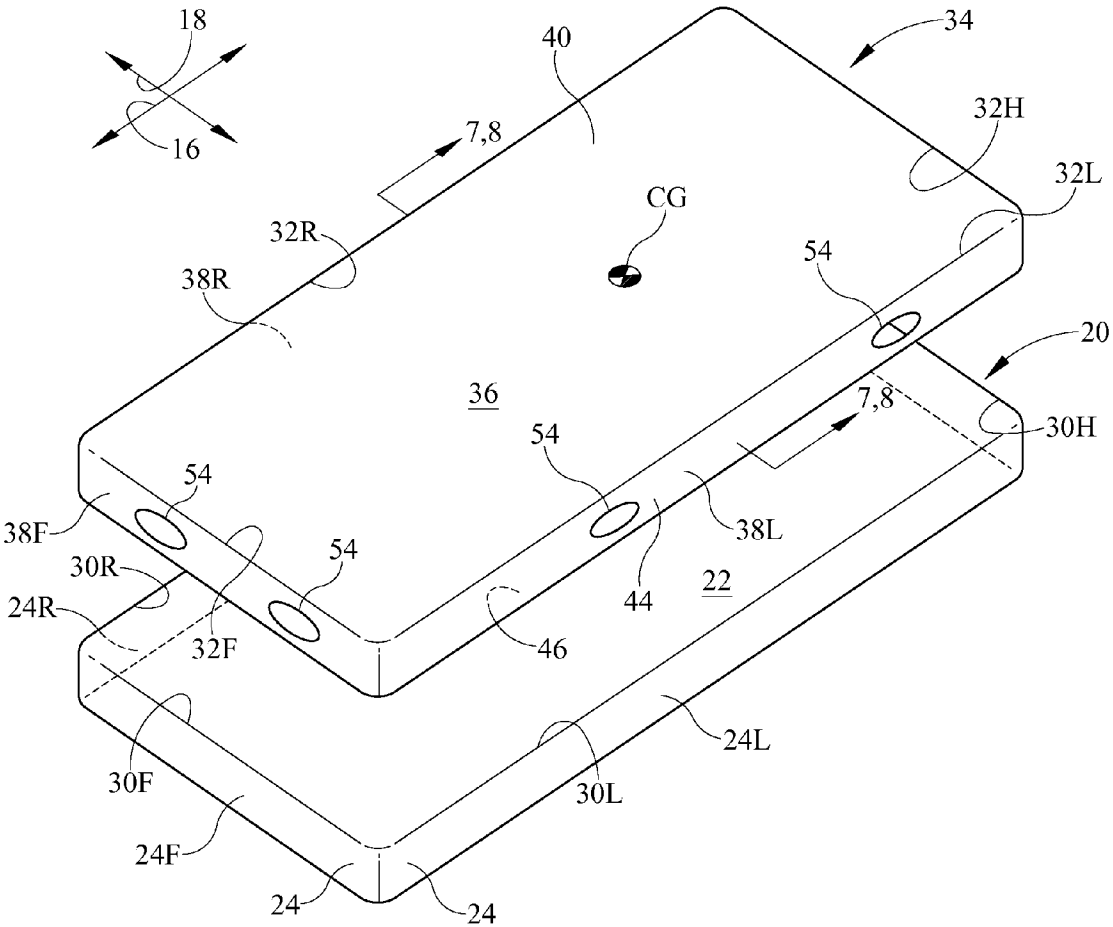
FIG. 1 is a perspective view of a mattress and the occupant transfer device in the form of a fitted sheet viewed from above.
Figure 2:
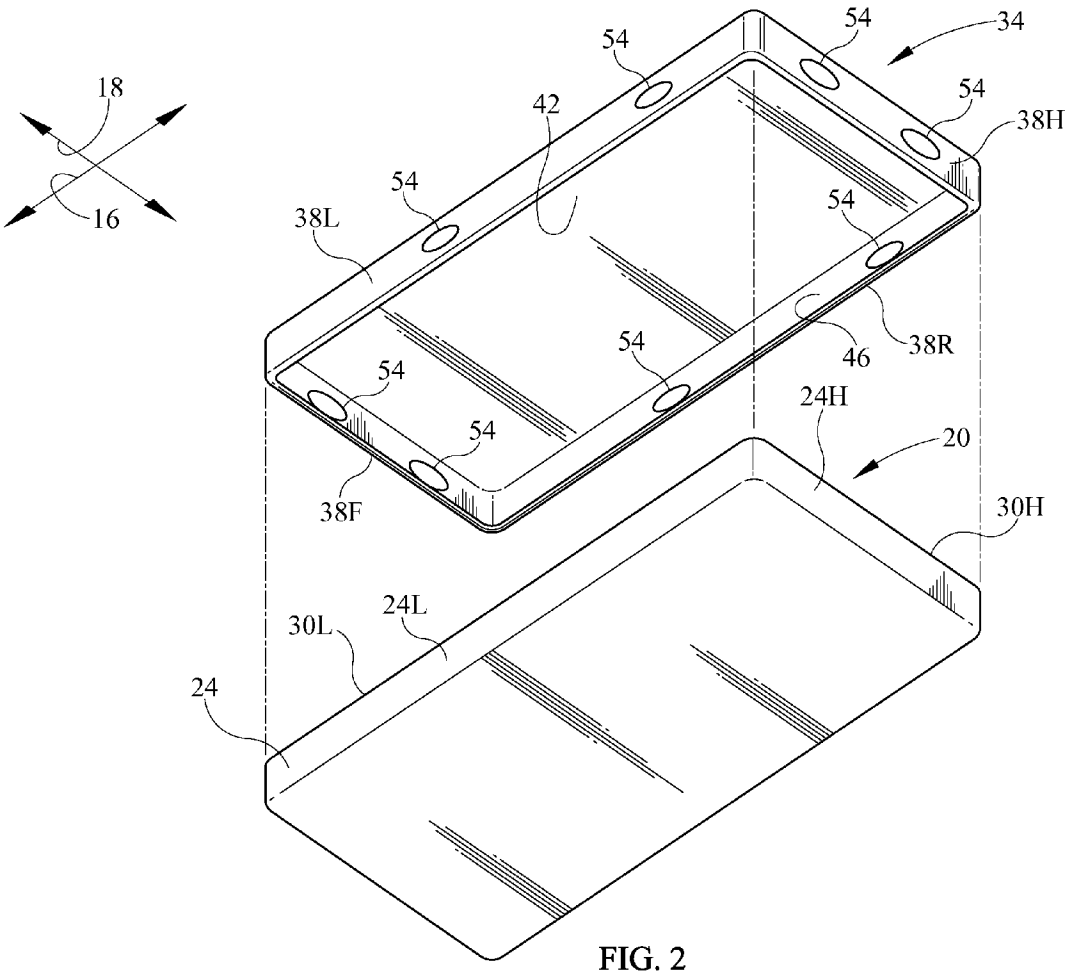
FIG. 2 is a perspective view of a mattress and the occupant transfer sheet viewed from below.
Figure 3:
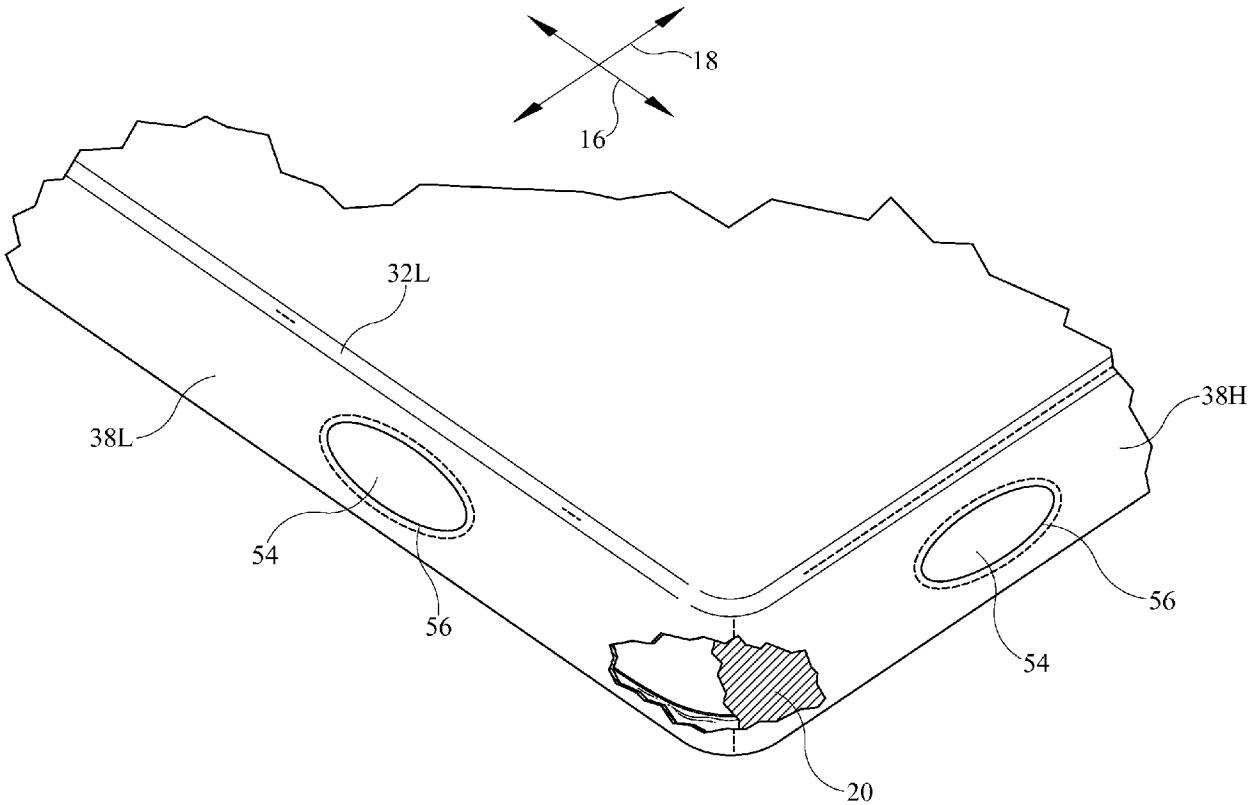
FIG. 3 is a perspective view of a corner of the occupant transfer sheet installed on a mattress and partially broken away to reveal the mattress.

FIGS. 1-3 show a bed for a hospital or other caregiving setting. The illustrations include reference axes 16, 18 indicating longitudinal and lateral directions respectively. The bed includes a mattress 20 having a top side 22 and a four-sided flank 24 comprised of left, right, foot end and head end flank sections 24L, 24R, 24F, 24H corresponding to the head, feet, left and right sides of a supine occupant of the bed. The mattress top side 22 and the four flanks 24 define mattress edges 30L, 30R, 30F, 30H. The mattress normally rests on a frame, not illustrated. The mattress hosts an occupant transfer device 34 which is in the form of a fitted bed sheet.

The occupant transfer sheet has a top 36 for covering the top side 22 of the mattress. When the sheet is installed on the mattress the top 36 is substantially spatially coextensive with the top side of the mattress. A skirt 38 having head, foot, left and right panels 38H, 38F, 38L, 38R extends from the top 36 to cover the mattress flanks. The top 36 of the sheet and the four skirt panels define sheet edges 32L, 32R, 32F, 32H. The portion of the skirt near the perimeter of the sheet is normally turned inward as seen in FIGS. 2 and 3 and tucked under the bottom of the mattress. Part or all of the sheet may be slightly elastic to ensure that the sheet fits snugly and securely on the mattress.

Figure 4:
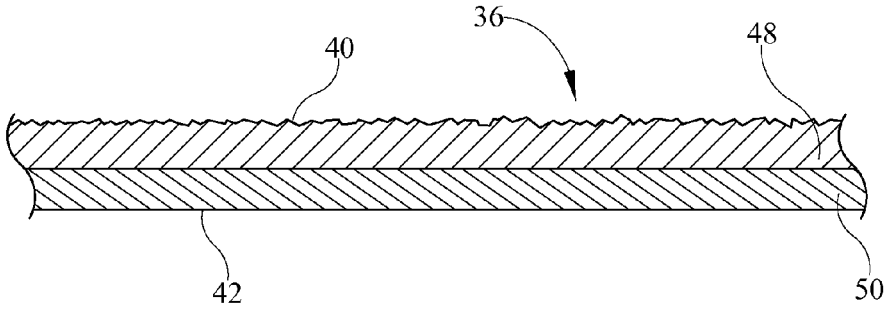
FIG. 4 is a partial side elevation view of the occupant transfer sheet showing distinct lamina forming high and low friction sides of the sheet.
Figure 5:
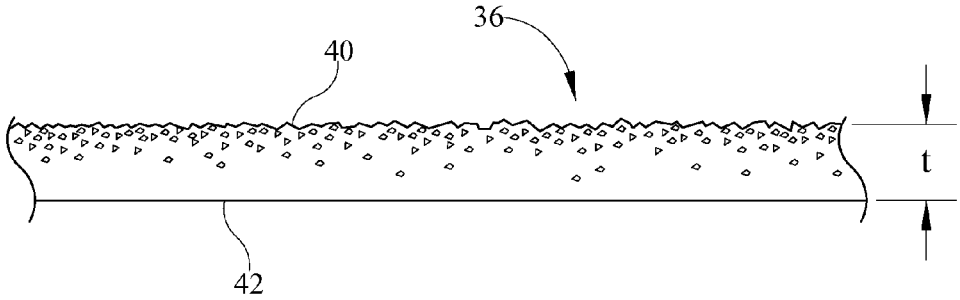
FIG. 5 is a partial side elevation view of the occupant transfer sheet with faceted symbols signifying graduated frictional properties through the thickness of the sheet.
Figure 6:
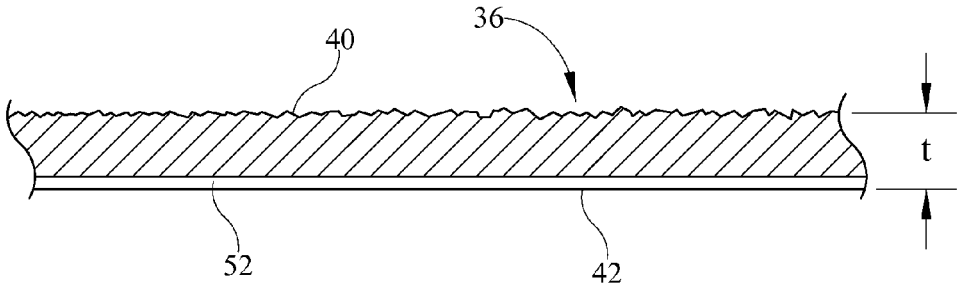
FIG. 6 is a partial side elevation view of the occupant transfer sheet with a coating to impart low friction to one side thereof.

The top 36 of the sheet has an occupant side 40 facing away from the mattress and a mattress side 42 facing toward the mattress. Likewise, the skirt panels 38 each have an occupant side 44 and a mattress side 46. Substantially all of the mattress side of the top 36 exhibits relatively low friction. The occupant side of at least the top exhibits relatively higher friction. The difference in friction can be achieved in any suitable manner. As seen in FIG. 4 the frictional properties of the occupant and mattress sides of the sheet may result from distinct high and low friction lamina 48, 50. Or, as seen in FIGS. 5 and 6, the frictional properties may vary as a function of sheet thickness t such that the occupant side is of relatively high friction (as suggested by the irregular line used to depict the occupant side 40) and the mattress side is of relatively low friction (as suggested by the smooth line used to depict the mattress side 42). In FIG. 5 the varying density of the faceted symbols between sides 40 and 42 signifies a graduated change in frictional properties. In FIG. 6 the low friction properties of the mattress side 42 result from a low friction coating 52.

Two openings 54 are formed on both the left and right side panels of the skirt. Similar openings may also be present on the head and/or foot skirt panels. The openings serve as hand-hold openings so that a caregiver can grasp the sheet and slide it, and the occupant lying thereon, from a source bed to a destination bed. The margin 56 of each opening is reinforced to resist ripping. The left and right panel openings are approximately longitudinally equidistant from the estimated location CG of an occupant's center of gravity.

Figure 7:
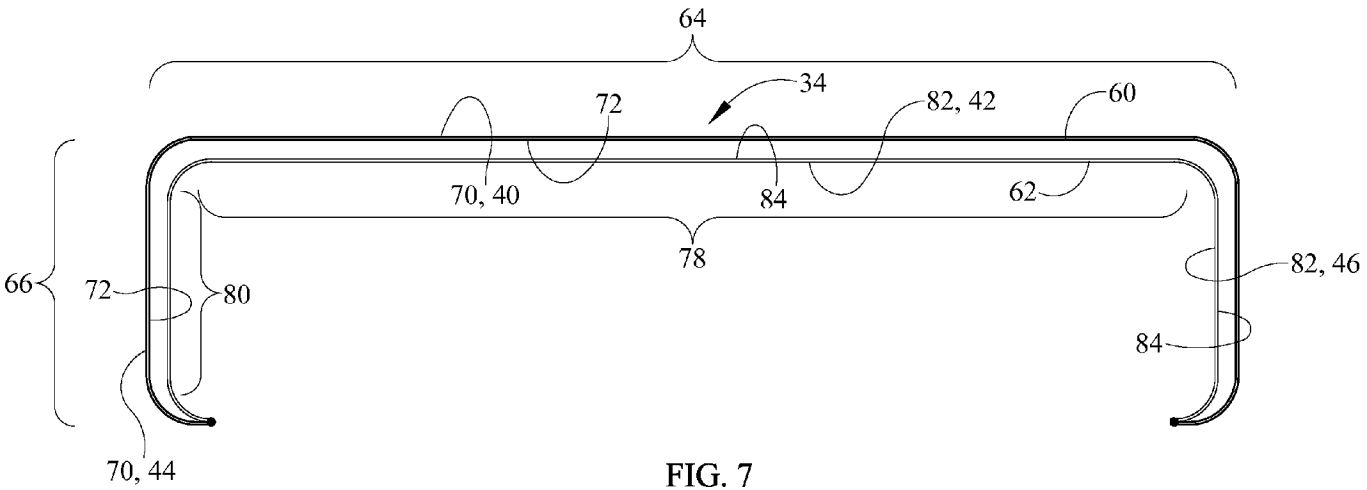
FIG. 7 is a view in the direction 7-7 of FIG. 1 showing an embodiment of the occupant transfer sheet having a relatively high friction outer layer and a relatively low friction inner layer, each having a skirt portion.
Figure 8:
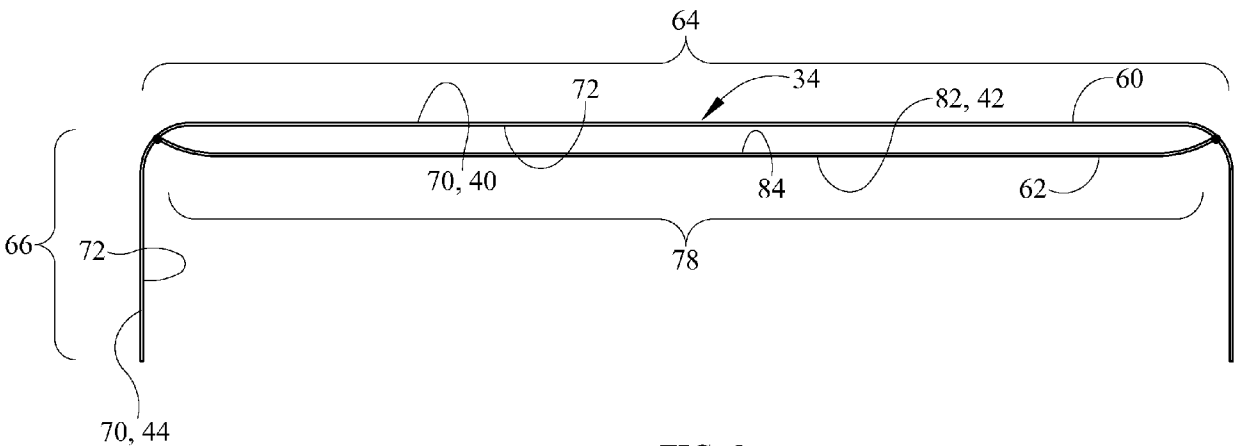
FIG. 8 is a view in the direction 8-8 of FIG. 1 showing an embodiment of the occupant transfer sheet having a relatively high friction outer layer and a relatively low friction inner layer, only the outer layer having a skirt portion.

As seen in FIGS. 7 and 8 one specific embodiment of the sheet is comprised of an outer layer made of cotton fabric 60 and a separate inner layer 62 made of rip-stop nylon. The outer layer has a top portion 64 for covering the top side of the mattress and a skirt portion 66 extending from the top portion and corresponding to the flank of the mattress. The outer layer has an exterior side 70 and an interior side 72. The exterior side 70 of the outer layer is the occupant side 40, 44 of the fitted sheet and therefore exhibits high friction.

The inner layer 62 has a top portion 78 substantially coextensive with the top portion 64 of the outer layer 60. The inner layer also has an optional skirt portion 80 (included in FIG. 7; excluded in FIG. 8) extending from the top portion and corresponding to the mattress flank. The inner layer has an exterior side 82 and an interior side 84. The exterior side 82 of the inner layer is the mattress side 42, 46 of the fitted sheet. The exterior side of the inner layer top portion 78, exhibits relatively low friction. If the inner layer includes the optional skirt portion, the exterior side of the inner layer skirt portion 80, is also preferably of low friction. The frictional properties of the inner layer may vary as a function of sheet thickness t such that the friction increases from the exterior side 82 toward the interior side 84.

The interior sides 72, 84 of the layers face each other and exhibit relatively low friction with respect to each other, allowing those interior sides to easily slide relative to each other.

Figure 9:
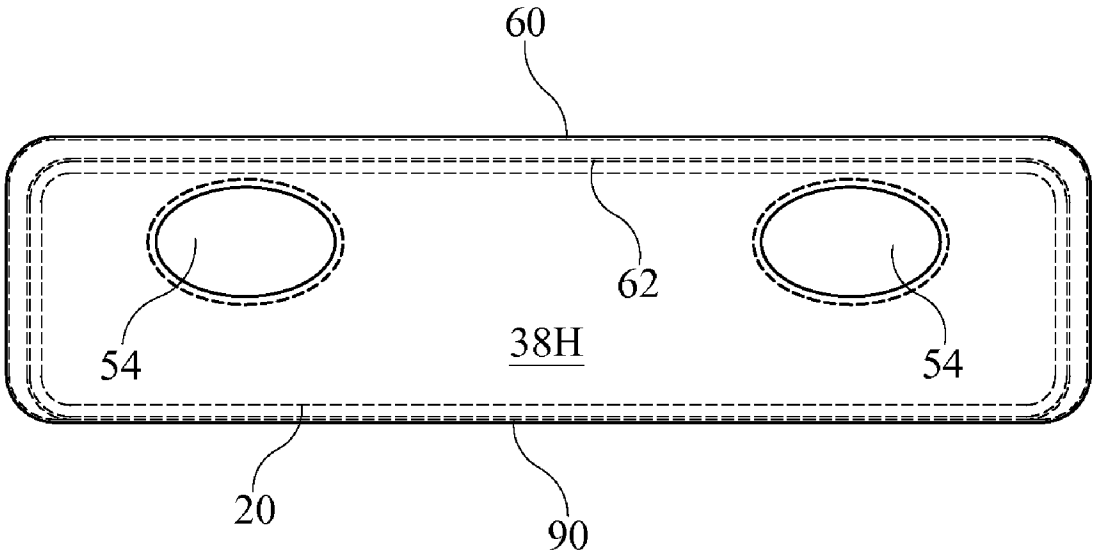
FIG. 9 is an end elevation view of the embodiment of FIG. 7 showing a continuous seam between the outer and inner layers along the head end panel of the sheet.
Figure 10:
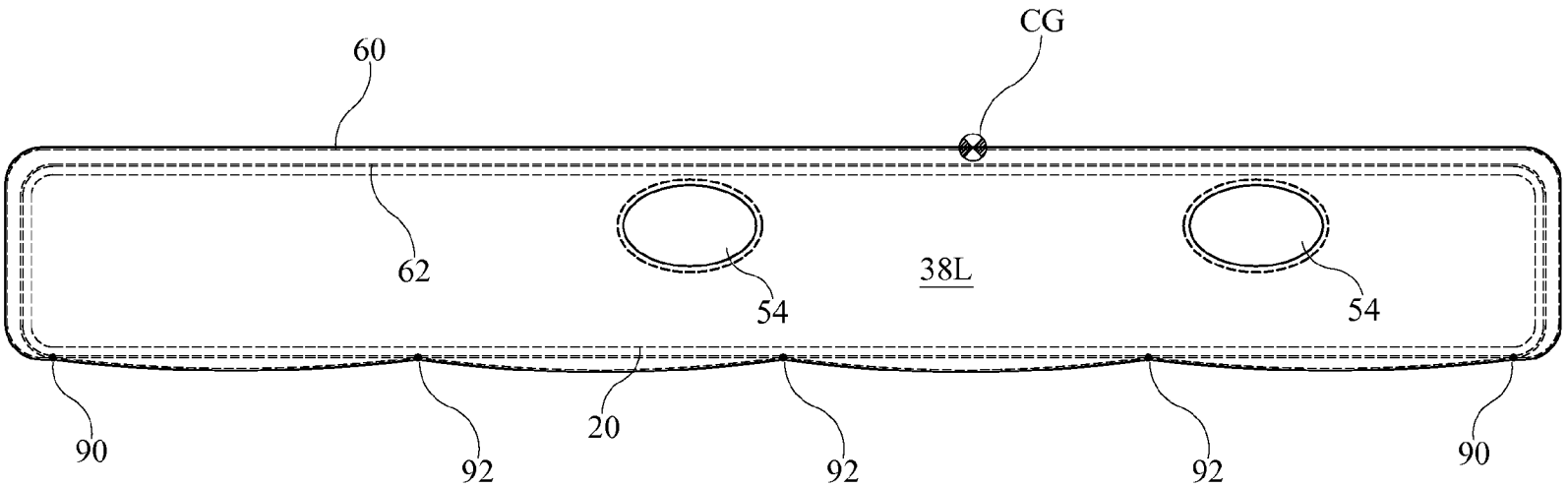
FIG. 10 is a side elevation view of the embodiment of FIG. 7 showing spot stitching between the outer and inner layers along the left side panel of the sheet.
Figure 11:
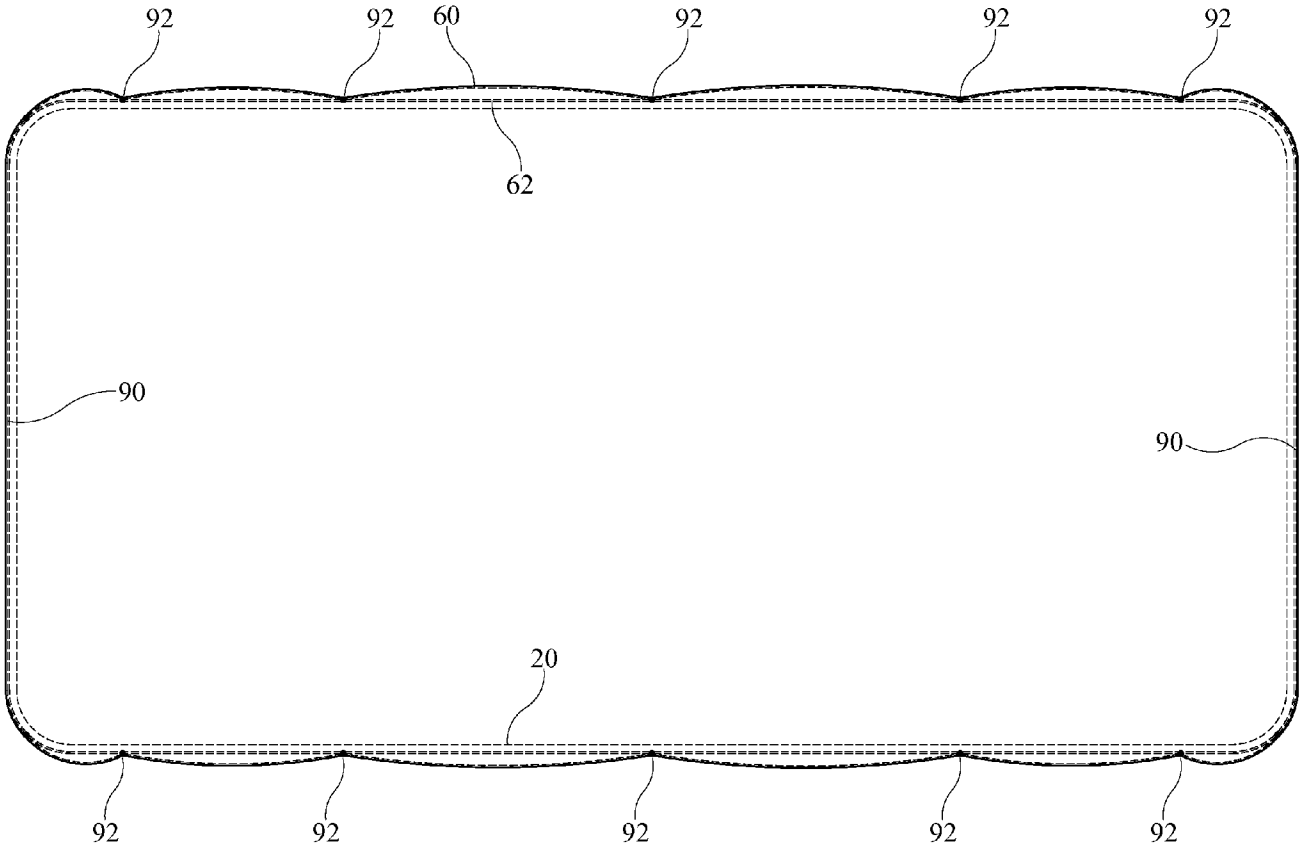
FIG. 11 is a plan view showing the continuous seam and spot stitching of FIGS. 9 and 10.

FIGS. 9-11 show how the inner layer 62 is stitched to the outer layer 60 near the layer edges. The stitching forms a continuous seam 90 along the head and foot ends of the sheet (FIGS. 9 and 11) The layers are spot stitched 92 to each other along the left and right sides (FIGS. 10 and 11). The continuous seam 90 imparts strength to the inter-layer connection whereas the spot stitching allows the inner and outer layers to slip or move independently relative to each other both longitudinally and laterally. The location and extent of the continuous seam and the location of the spot stitching can be varied to achieve the desired combination of strength and inter-layer slippage. Although the illustrated sheet employs a combination of continuous stitching and spot stitching, either way of stitching can be used exclusively.

Openings 54 are formed by openings in the skirt portion left and right panels of the outer layer and companion openings in the skirt portion left and right panels of the inner layer. Similar openings may also be present on the head and/or foot skirt panels of the outer and inner layers. The margin of each outer layer opening is substantially continuously stitched, or otherwise attached, to the margin of its companion opening in the inner layer to form the opening margin 56.

Figure 12:
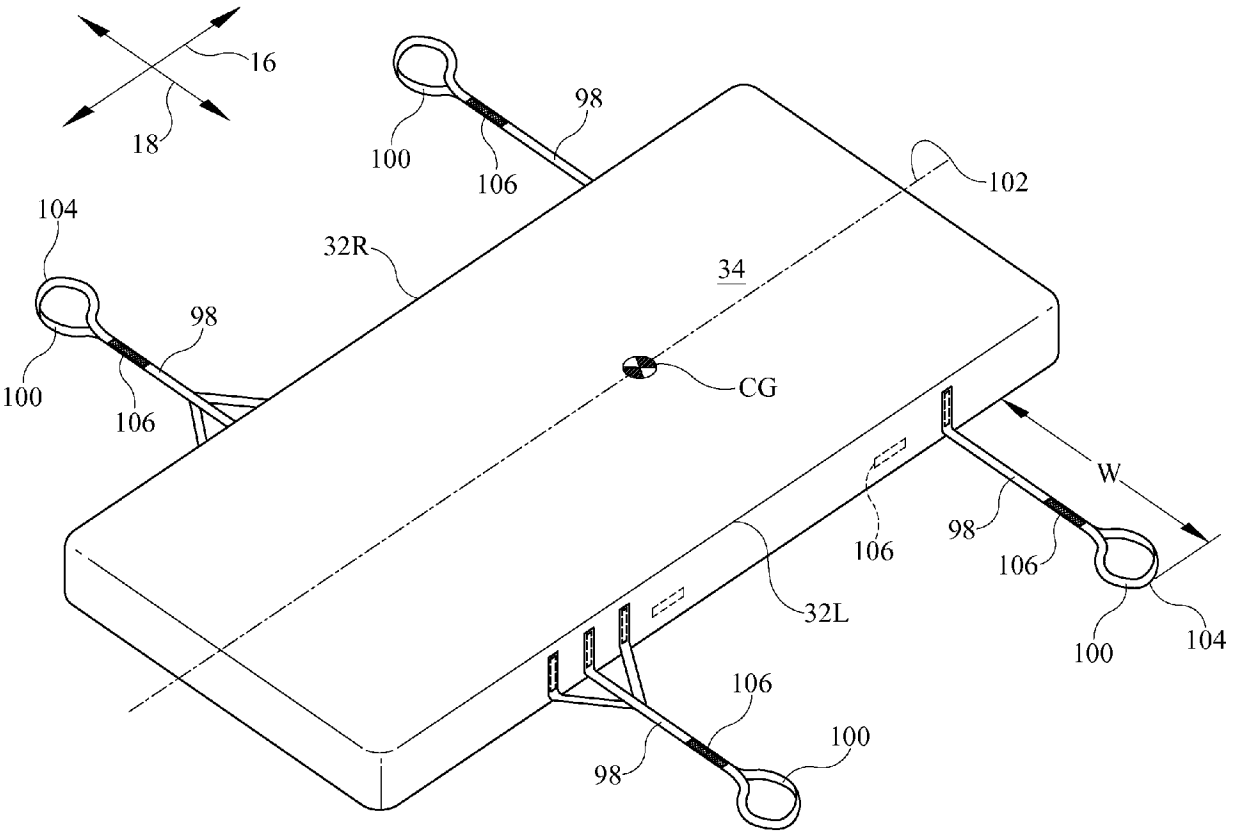
FIG. 12 is a perspective view of an occupant transfer sheet having bridge straps secured thereto

Referring to FIG. 12, inelastic bridge straps 98 having a grip loop 100 are secured to and extend from the occupant transfer sheet 34 instead of or in addition to openings 54. FIG. 12 shows two possible types of attachment—a linear attachment nearer the head end of the sheet and a "delta" attachment nearer the foot end. Each strap has a working length W which is the distance from the left or right lateral edge 30L, 30R of the mattress (corresponding to the left and right edges 32L, 32R of the sheet) to the end 104 of the grip loop when a strap is extended substantially perpendicular to the longitudinal centerline 102. The minimum working length equals about the width of a destination mattress reduced by the arm length of a fifth percentile female. Typical mattress widths in use in the United States are 36 inches (approximately 91.4 cm.) for non-bariatric mattresses and 40 inches (approximately 101.5 cm) for bariatric mattresses. The arm length of a fifth percentile female can be determined from anthropometric data, such as the data compiled in "The Measure of Man and Woman—Human Factors in Design" by Alvin R. Tilley, ISBN 0-471-09955-4.

Figure 13A:
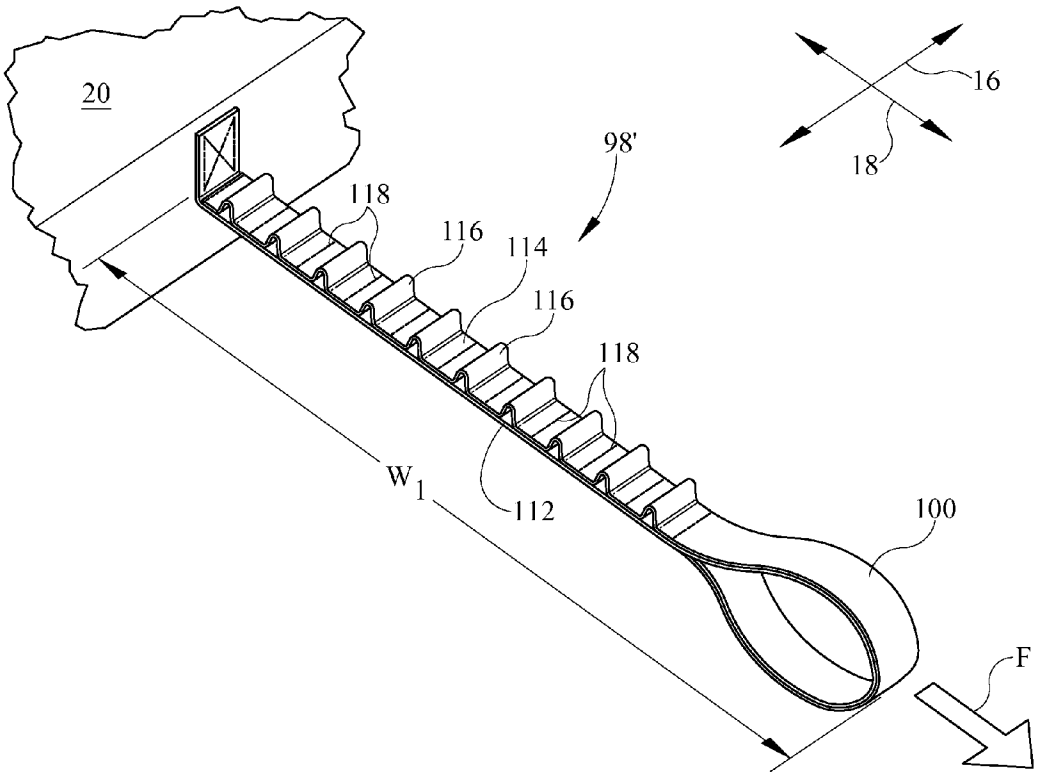
FIGS. 13A and 13B are perspective views showing a bridge strap featuring an elongation limited elastic construction, FIG. 13A showing the strap in a relaxed state and FIG. 13B showing the strap in a partially elongated state.
Figure 13B:
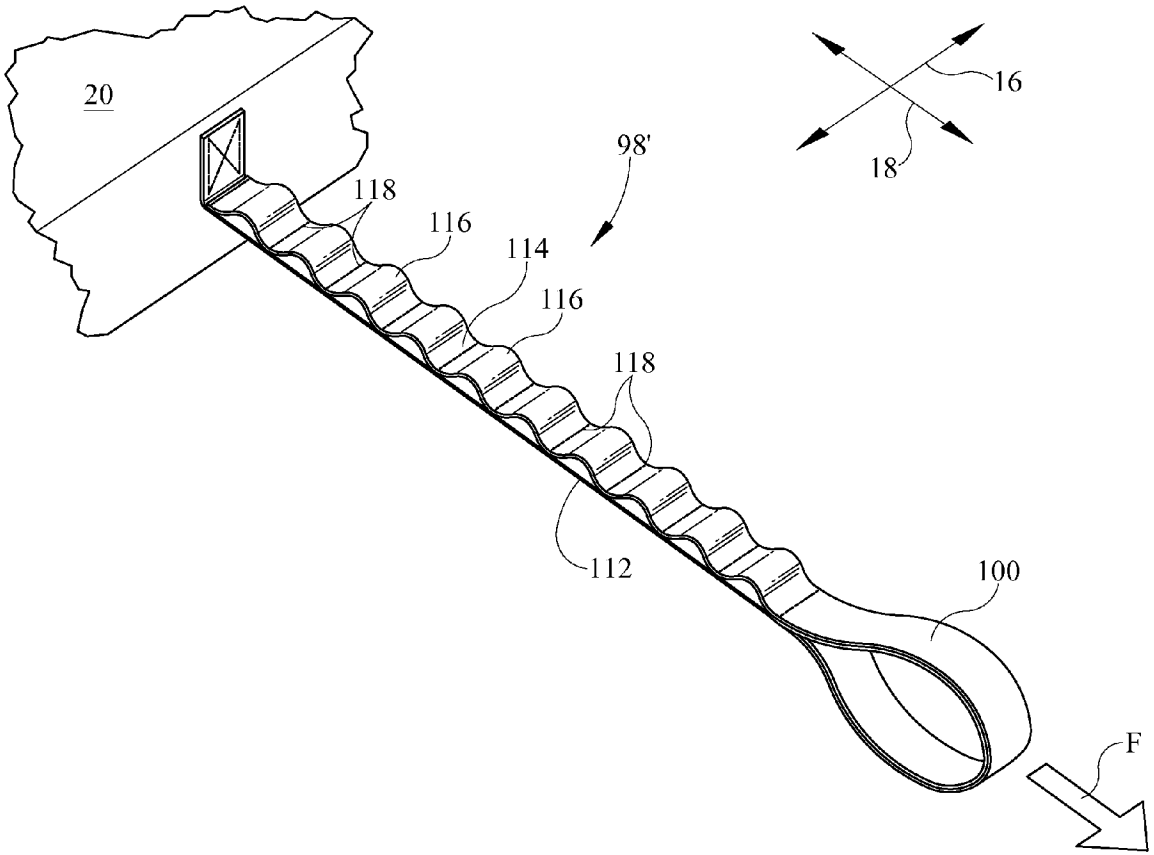

FIGS. 13A and 13B show an alternative construction for a bridge strap. Referring first to FIG. 13A bridge strap 98' comprises an elastic member 112, shown in its relaxed state, and an inelestic member 114. The inelastic member includes folds 116 and is attached to the elastic member at locations 118 intermediate the folds. When not in use, the bridge strap has a length $W_1$, smaller than its working length W. The smaller length allows the strap to be stored, when not in use, more conveniently than a strap of fixed length W. When a caregiver applies a force F to the strap, elastic member 112 stretches under the load while inelastic member 114 unfolds as seen in FIG. 13B. In the limit, the inelastic member extends unfolded along the stretched length of the elastic member thus providing a second load path in parallel with the load path through the elastic member and preventing any further elongation of the elastic member. The strap is thus at its full working length W.

It may be desirable to provide a way to secure the straps between the mattress flanks 24 and the mattress sides 48 of the sheet skirt 38 when the straps are not in use. To this end the straps and sheet include mating fasteners, such as mating hook and loop fasteners 106 (FIG. 12). When the straps are not in use they may be stored securely but accessibly in the space between the mattress flank and the skirt portion of the sheet with the hook and loop fasteners keeping the straps in place.

Figure 14:
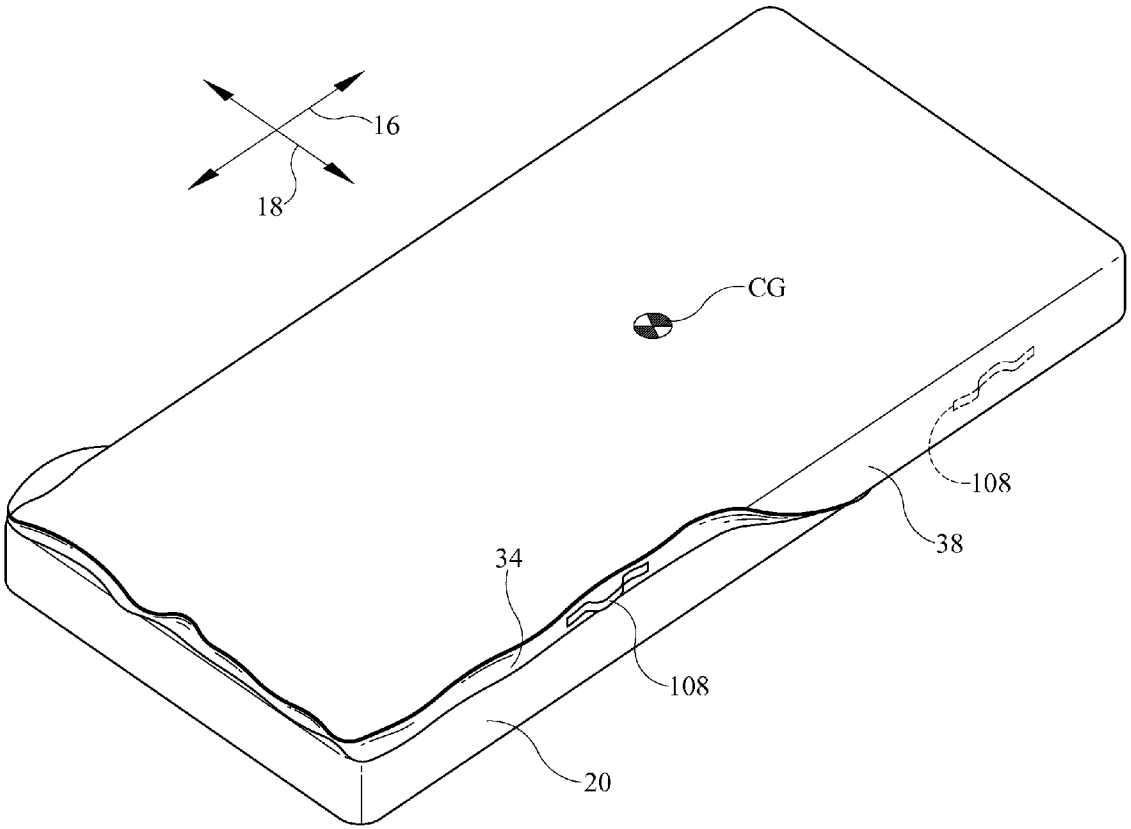
FIG. 14 is a perspective view of a mattress with an occupant transfer sheet partially installed and a portion of the sheet turned up to reveal a loop handle.

Referring to FIG. 14 it may also be desirable to include loop handles 108 secured to the mattress side of the skirt of the sheet instead of or in combination with the openings 54 and/or the bridge straps 98. When the handles are not in use they remain stored between the mattress and the sheet where they are easily accessible when needed but out of the way when not. To use the loop handles rather than the hand-hold openings, a caregiver first turns up the skirt panel to gain access to the loop handles. If desired the loop handles could be installed on the occupant side of the sheet skirt instead of on the mattress side.

Figure 15:
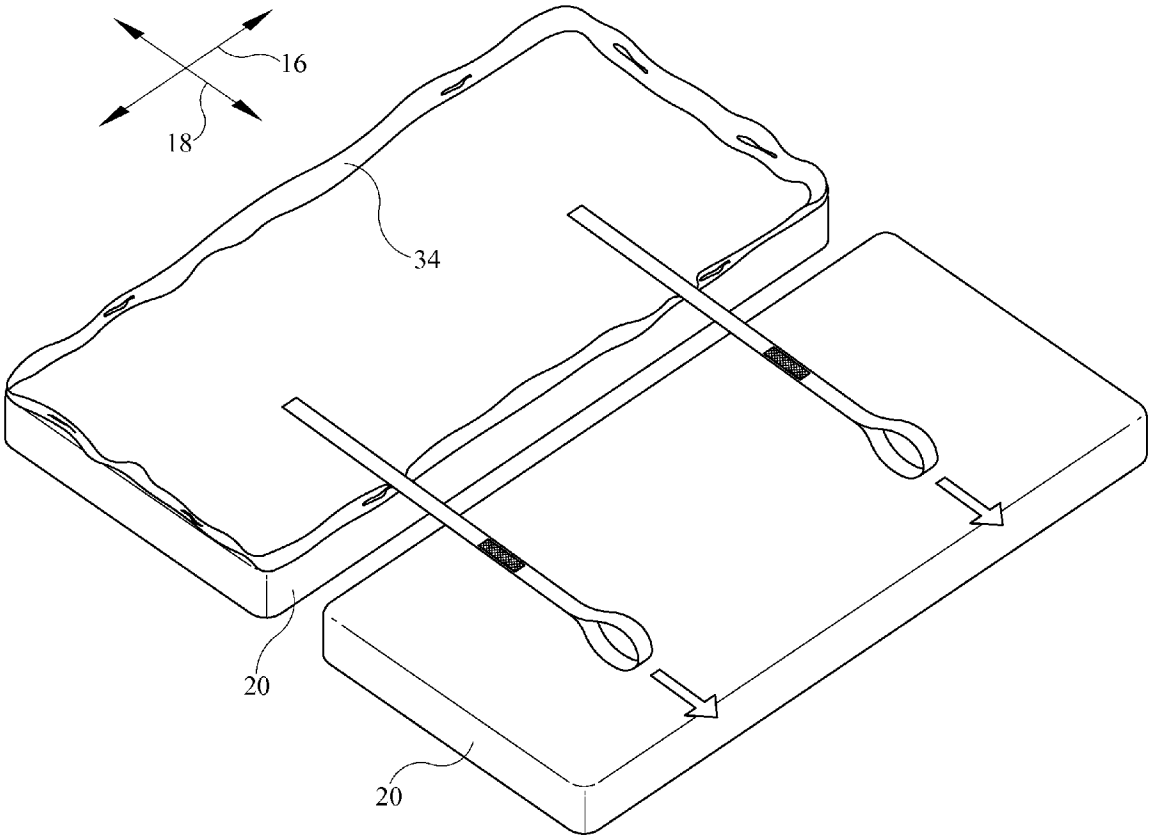
FIG. 15 is a perspective view showing the use of the bridge straps to transfer the occupant transfer sheet from a source mattress to a destination mattress.

The occupant transfer device doubles as a fitted sheet which is used on the mattress in lieu of a conventional fitted sheet. As a result the caregiver staff need not retrieve a dedicated transfer apparatus from a remote location and position the apparatus under the occupant as a prelude to occupant transfer. Instead, as seen in FIG. 15, it is envisioned that a staff member will untuck the perimeter edge of the occupant transfer sheet, position a destination bed laterally along side the source bed occupied by the occupant, and deploy the bridge straps 98 by lying them across the top side of the destination mattress as shown. The caregiver positions himself along the lateral edge of the destination mattress remote from the source mattress. Because of the working length of the bridge straps, the free ends of the straps will be within easy reach of the caregiver. Accordingly, the caregiver can grasp the straps and pull the transfer sheet and the occupant onto the destination mattress without assuming a risky posture. If desired the caregiver can grasp the handhold openings or the loop handles to finish the transfer. As already noted the bridge straps may be dispensed with in favor of the openings 54 and/or loop handles 108, but will lack the ergonomic benefits of a transfer sheet with bridge straps.

Although this disclosure refers to specific embodiments, it will be understood by those skilled in the art that various changes in form and detail may be made without departing from the subject matter set forth in the accompanying claims.

We claim:

1. An occupant transfer device for use on a host mattress having a top side and a flank, the device comprising a fitted sheet having a top for covering substantially all of the top side of the mattress and a skirt extending from the top, the top and skirt each having:

an inner layer with a top portion for covering the top side of the mattress, the inner layer also having an exterior side and an interior side wherein the exterior side of the inner layer is a mattress side of the fitted sheet, and an outer layer having a top portion substantially coextensive with the top portion of the inner layer, the outer layer also having an exterior side and an interior side wherein the exterior side of the outer layer is an occupant side of the fitted sheet, substantially all of the top portion of the inner layer exhibiting relatively low friction, and the top portion of the outer layer exhibiting relatively higher friction.

2. The device of claim 1 wherein the skirt portion of the inner layer also exhibits relatively lower friction.

3. The device of claim 1 wherein the relatively low friction results from a coating.

4. The device of claim 1 including aligned openings in the skirt portion of the outer layer and the skirt portion of the inner layer, each opening having a margin, the margins being substantially continuously attached to each other.

5. The device of claim 1 including a bridge strap secured to the sheet, the bridge strap having a working length of approximately at least the width of a destination mattress minus the arm length of a fifth percentile female.

6. The device of claim 5 wherein the destination mattress is a bariatric mattress.

7. The device of claim 5 wherein the bridge strap is storable between the mattress and the skirt.

8. The device of claim 1 including a loop handle secured to the mattress side of the sheet.

9. The occupant transfer device of claim 1 wherein the inner layer has an inner layer edge, the outer layer has an outer layer edge, the layer edges being joined to each other over at least part of their respective lengths with a continuous seam and over any remainder of their respective lengths with spot connections.

10. The occupant transfer device of claim 9 wherein the layer edges are joined to each other with the continuous seam along laterally extending portions thereof and are joined to each other with the spot connections along longitudinally extending portions thereof.

* * * * *